US007100769B2

(12) United States Patent
Tourre et al.

(10) Patent No.: US 7,100,769 B2
(45) Date of Patent: Sep. 5, 2006

(54) PACKET OF TISSUES

(75) Inventors: Christian Tourre, Arrebloy (FR); Sylvain Breteau, Colmar (FR); Pierre Laurent, Turckheim (FR)

(73) Assignee: Georgia-Pacific France, Kunheim (FR)

( * ) Notice: Subject to any disclaimer, the term of this patent is extended or adjusted under 35 U.S.C. 154(b) by 565 days.

(21) Appl. No.: 09/852,712

(22) Filed: May 11, 2001

(65) Prior Publication Data

US 2001/0040107 A1 Nov. 15, 2001

(30) Foreign Application Priority Data

May 11, 2000 (EP) ..... 00401294

(51) Int. Cl.
*B65D 73/00* (2006.01)

(52) U.S. Cl. ..... 206/494; 206/233

(58) Field of Classification Search ..... 206/494, 206/812, 581, 233, 37, 38, 361, 271; 221/47, 221/48, 63; D9/433; 229/87.05
See application file for complete search history.

(56) References Cited

U.S. PATENT DOCUMENTS 3,129,811 A * 4/1964 Williams et al. ..... 206/361
4,229,926 A * 10/1980 Rowling ..... 53/429
4,460,088 A * 7/1984 Rugenstein et al. ..... 206/494
5,018,625 A * 5/1991 Focke et al. ..... 229/87.05
5,182,895 A * 2/1993 Lugo ..... 53/469
5,184,725 A * 2/1993 Reinheimer et al. ..... 206/494
5,244,025 A * 9/1993 Wewers ..... 150/154
5,333,735 A * 8/1994 Focke et al. ..... 206/494
5,358,171 A * 10/1994 Focke ..... 229/87.05
5,361,936 A * 11/1994 Cook ..... 221/63
5,511,658 A * 4/1996 Focke et al. ..... 206/271
5,516,000 A 5/1996 Freiburger et al.
5,524,759 A * 6/1996 Herzberg et al. ..... 206/494
5,564,562 A * 10/1996 Focke et al. ..... 206/233
D463,975 S * 10/2002 Sipinen ..... D9/339

FOREIGN PATENT DOCUMENTS

EP 0030601 6/1981
EP 0446628 A1 9/1991
EP 0858958 A2 8/1998

* cited by examiner

*Primary Examiner*—Shian T. Luong
(74) *Attorney, Agent, or Firm*—Finnegan, Henderson, Farabow, Garrett & Dunner, L.L.P.

(57) ABSTRACT

A packet of stacked absorbent paper tissues, such as a plastic wrapping sheet includes an opening part allowing a region to be uncovered for grasping at least one tissue so as to extract it individually from the wrapper, with a parallelepipedal overall shape defined by a height, a width and a thickness, the height and the width being equal so that the packet has square front and rear frontal faces.

16 Claims, 3 Drawing Sheets

PACKET OF TISSUES

BACKGROUND OF THE INVENTION

The invention relates to a packet of tissues.

The invention relates more particularly to a packet of stacked absorbent paper tissues.

DESCRIPTION OF THE RELATED ART

Paper tissues are generally made from a sheet of absorbent paper which is folded and cut to a rectangular format, preferably a square format. The folded tissues are then juxtaposed or stacked then wrapped in a sheet of flexible material which may be a film of transparent plastic.

The packet of stacked tissues has a rectangular parallelepipedal shape, with a large rectangular face whose width is less than its height.

In general, an opening is made in a large face of the wrapper which is approximately parallel to the plane of the tissues, so as to uncover a region for grasping at least one tissue in order to extract it individually from the packet.

The opening may consist in a flap which can move about an axis which, when in the open position, allows the region for grasping to be uncovered.

Holding means, such as an adhesive strip, fixed to the mobile flap are needed to hold the flap in the closed position.

Such packets exhibit numerous drawbacks; they are bulky and indiscreet, as their dimensions and format are fairly large. They can thus deform and damage clothing, particularly pockets into which they are slipped.

Once the packet is open, the manipulation it undergoes gives rise to deformation such as folding which deforms the tissues. Thus, when these are taken out of the packet, they have folded or crumpled regions which detracts from their appearance.

When the packet undergoes deformation, particularly twisting roughly about an axis corresponding to its largest longitudinal dimension, the holding means are not always strong enough to seal the grasping region of the packet closed. The free edges of the moving flap often break contact with the free edges of the opening, dust thus being able to enter the packet and dirty the tissues.

The advantages that paper tissues offer per se, namely the fact that they are always clean and more hygienic than textile handkerchiefs because of their one-use nature, are then greatly diminished.

In addition, when the mobile flap is in the open position, the holding means which generally comprise an adhesive strip may, for example, stick to one of the tissues or to the user's fingers and thus impede the extraction of the tissues.

SUMMARY OF THE INVENTION

With a view to overcoming these drawbacks, the invention proposes a packet of stacked absorbent paper tissues of the type which comprises a sheet of flexible material, such as a plastic wrapping sheet which comprises opening means allowing a region to be uncovered for grasping at least one tissue so as to extract it individually from the wrapper, and of the type which is of parallelepipedal overall shape defined by a height, a width and a thickness, characterized in that the height and the width are equal so that the packet has square front and rear frontal faces.

According to other features of the invention:

each tissue is folded in such a way as to form a square, the number of absorbent paper thicknesses of which is a multiple of four;

each folded tissue has sixteen thicknesses of absorbent paper;

folding each tissue into sixteen thicknesses consists in folding four panels of approximately equal width, separated by longitudinal fold lines, the directions of folding of the panels with respect to the outer fold lines being mutually opposing, then in folding the panels in succession about a first fold line and a second fold line;

its height and its width are between 50 and 58 millimeters;

the opening means comprise a flap which can move between an open position uncovering the region for grasping at least one folded tissue and a closed position covering the region for grasping;

the surface of the region for grasping uncovered by the moving flap is between one third and half of the area of a face comprising the opening means;

the moving flap is articulated about an axis approximately parallel to one of the edges of the packet;

the moving flap comprises means for holding it in the closed position, such as an adhesive strip which can be unstuck and restuck several times onto a fixed part of the wrapper;

the moving flap is a part of the wrapping sheet delimited by a pre-cut or a cut in the wrapping sheet comprising two portions which are joined together and each of which extends over a separate face of the packet;

the moving flap is part of the wrapping sheet delimited by a precut or a cut in the wrapping sheet arranged in a corner of the packet and comprising three portions, each of which extends over a separate face of the packet, a first portion extends over a first face between two concurrent edges, and the second and third portions extend over a respective second and third face from each of the ends of the first portion;

the first portion is an arc of a circle, the centre of which corresponds approximately to the point of concurrency of the three edges which delimit the corner of the packet;

the first portion comprises at least one straight-line segment;

the first face is one of the frontal faces;

the first face is one of the faces adjacent to the frontal faces.

BRIEF DESCRIPTION OF THE DRAWING

Other features and advantages of the invention will become apparent from reading the detailed description which follows, for the understanding of which reference will be made to the appended drawings among which.

DESCRIPTION OF THE PREFERRED EMBODIMENTS

Figure 1:
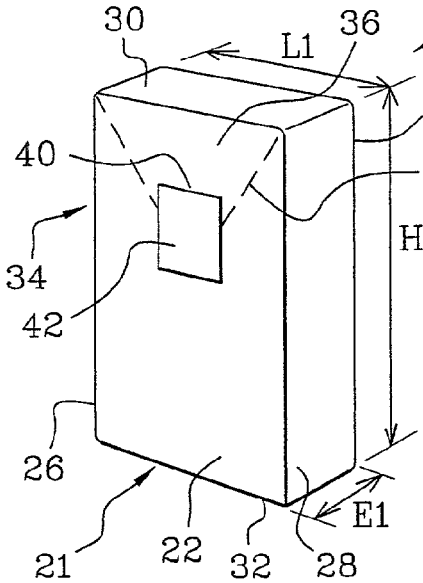
FIGS. 1 and 2 are views, each of which diagrammatically depicts, in perspective, one example of a packet of tissues produced according to the state of the art.
Figure 2:
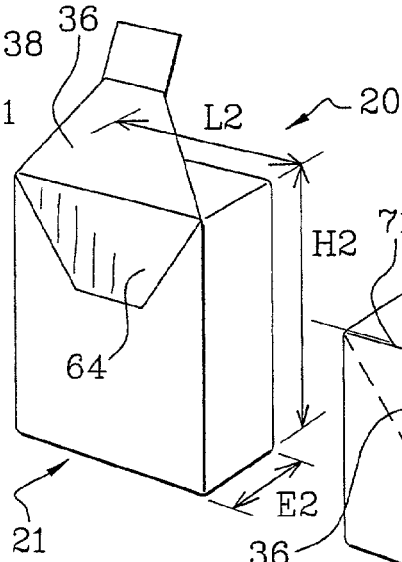
Figure 3:
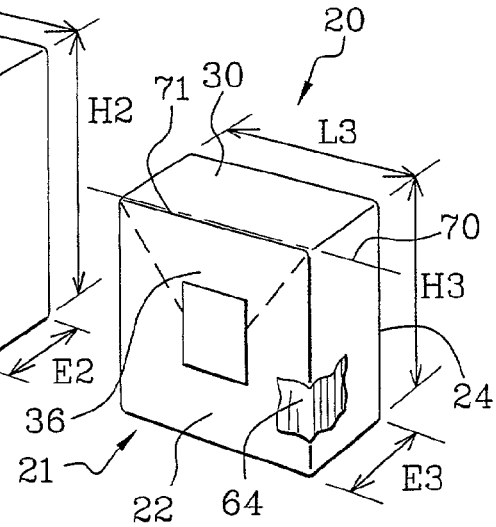
FIG. 3 diagrammatically depicts, in perspective, a packet of tissues produced according to the invention.
Figure 10:
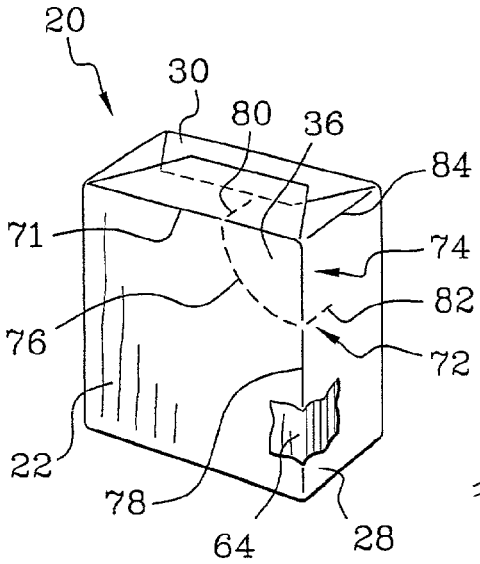
FIG. 10 is a diagrammatic perspective view of a packet of tissues comprising opening means produced according to an alternative form of the invention.

To facilitate the understanding of the description and of the claims, the terms front, rear, right, left, top and bottom will be used, without any implied limitation, in accordance with the figures, particularly FIGS. 1 to 3.

FIGS. 1 and 2 each depict a packet 20 of paper tissues according to the state of the art.

The packet 20 of paper tissues is of rectangular parallelepipedal overall shape. It consists of a wrapping sheet 21 made of flexible material, such as a sheet of plastic, and comprises two frontal faces, front 22 and rear 24, and four side faces, left 26, right 28, upper 30 and lower 32.

The wrapping sheet 21 is made of a flexible material, generally a film of polyethylene of between 20 and 50 microns thick.

The packet 20 of tissues comprises, in this instance on its front frontal face 22, opening means 34 which consist in a flap 36 which is precut along dotted lines 38.

FIG. 1 depicts the flap 36 in a closed position. FIG. 2, for its part, depicts the flap 36 in an open position.

At the time of first use, pulling the lower part 40 of the flap 36 forwards and/or towards the top of the packet 20 allows it to be detached from the front frontal face 22. The flap 36 can then move between its closed position and an open position uncovering a region for grasping at least one paper tissue.

In order to hold the flap 36 in the closed position after its first use, holding means 42, such as an adhesive strip, are fixed to the lower part 40 of the triangular flap 36. The holding means 42 can be unstuck and restuck several times onto the front frontal face 22 of the wrapper 21.

The packet 20 of tissues is defined by a height H, a width L and a thickness E.

FIG. 1 depicts a packet 20 of folded paper tissues of a so-called "conventional" format which is characterized in that its height H1 is roughly equal to twice its width L1.

FIG. 2, for its part, depicts a packet 20 of tissues of a format marketed under the trade mark "Compact", in which the height H2 roughly corresponds to one and a half times its width L2.

These two types of packet 20 of tissues have, in particular, the drawbacks mentioned above.

With a view to overcoming these drawbacks, the invention proposes, in accordance with FIG. 3, that the height H3 and the width L3 of the packet 20 be equal, so that the front 22 and rear 24 frontal faces are square.

The dimensions of the height H3 and the width L3 of the packet 20 may, however, have a tolerance of plus or minus 4 millimeters for a standard deviation of the order of 2 mm.

This tolerance also applies on the dimension of the height with respect to the dimension of the width.

Thus, "equal height and width" is to be understood as meaning a height and width which may not be strictly equal and may vary to a certain extent with respect to one another.

As a preference, the width L3 of the packet 20 according to the invention is equal to the widths L1 and L2 of the packets 20 according to the state of the art, that is to say has a value of between 50 and 58 mm.

Thus, when the ratio between the height H3 and the width L3 is equal to 1, the height H3 is roughly equal to half the height H1, and is less than the height H2 of the packets 20 produced according to the state of the art.

The dimensions of the packet 20 according to the invention are reduced with respect to the packets 20 of tissues of known types.

The packet 20 according to the invention is discrete and is able to reduce the bulkiness, for example of pockets and handbags.

It also limits the risk of damaging garments, particularly pockets, into which it is slipped.

The parallelepipedal format of the packet 20, with square frontal faces 22 and 24, makes it possible to improve its rigidity. Thus, it is more rigid and retains its shape when stressed, particularly when in trouser pockets or in a handbag.

Tests have been performed on packets 20 of tissues of known types, particularly packets whose height H2 is roughly equal to 1.5 times its width L2, and packets 20 according to the invention.

A first test consists in evaluating the resistance of a packet 20 to crushing. To do this, a side face of the packet 20 is placed on a flat surface, then a deformation member presses on the opposite side face of the packet 20. The rate of displacement, for example 400 mm per minute, and the stroke of the member, for example 15 mm, are constant. Measurement means such as a dynamometer, determine the force measured on the packet 20. Thus, the greater the force applied to crush the packet 20, the more resistant the packet 20.

A second test consists in evaluating the bending strength of a packet 20.

Thus, for example, the rear frontal face 24 is placed on two linear supports located near the edges common to the rear frontal face 24 and the upper side face 30 and lower side face 32 respectively. Next, a deformation member presses on the front frontal face 22. The rate of displacement, for example 400 mm per minute, and the stroke of the member, for example 20 mm, are constant. The measurement means thus determine the force applied to the packet 20 needed to deform it through predetermined travel.

These tests were performed several times with packets 20 full or partially full of tissues.

In all instances, packets 20 according to the invention are more resistant to crushing and have better bending strengths than the packets 20 of known types.

For example, when the deformation member presses on the upper side face 30, a packet 20 filled with tissues according to the invention has a resistance 2.5 times higher than that of a packet 20 of known type.

When the packet 20 is partially filled, particularly when it contains three folded tissues, the ratio between the resistance of a packet 20 according to the invention and that of a packet 20 of known type may be as high as 16.

These tests show that the shape and dimensions of the packet of tissues 20 according to the invention greatly improve its resistance and strength. Its deformations during use are reduced.

The tissues are folded to then be placed inside the wrapper of flexible material or wrapped with the latter.

FIGS. 4 to 9 illustrate the various steps in one example of the folding of a sheet 50 of absorbent material to make a tissue folded into a square.

Figure 4:
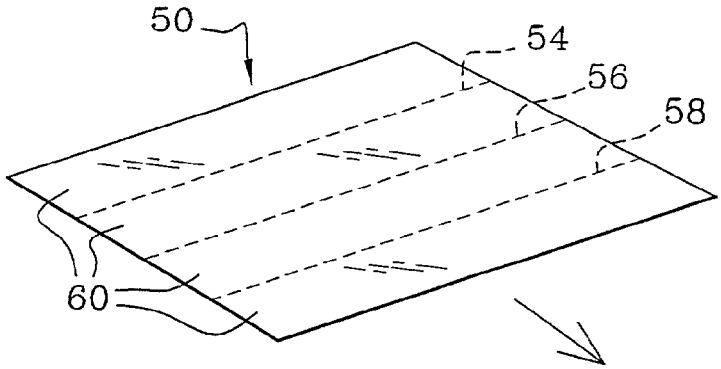
FIGS. 4 to 9 are diagrammatic views depicting the successive steps in folding a tissue wrapped in the packet according to the invention of FIG. 3.

FIG. 4 here depicts a cut sheet 50 of square shape, the sides of which are of the order of 210 mm long, made of absorbent flexible material such as cellulose wadding.

Such sheets are known and in widespread use in the state of the art.

The sheet 50 consists of at least one ply of flexible and absorbent material. When there are several plies, they may be joined together, for example by bonding or any other mechanical method of connection.

Figure 5:
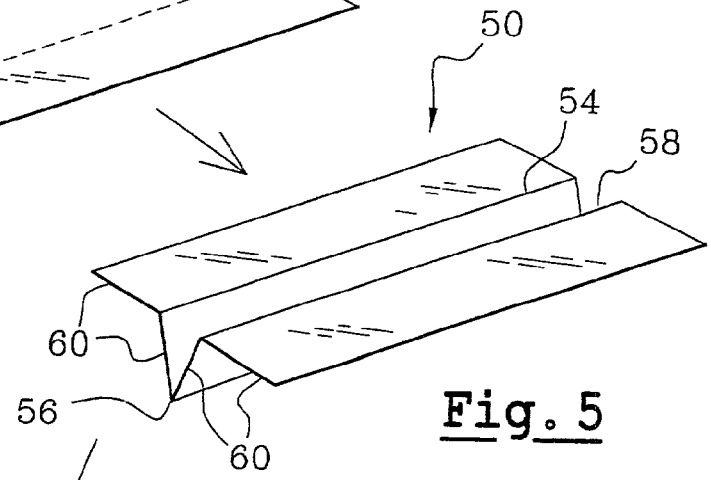
Figure 6:
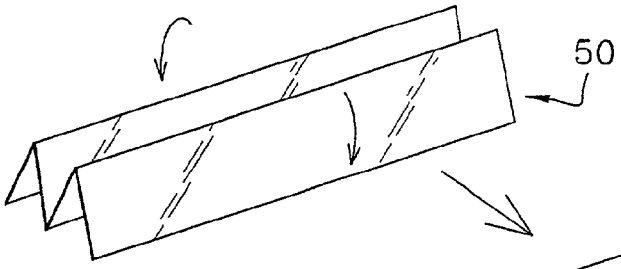
Figure 7:
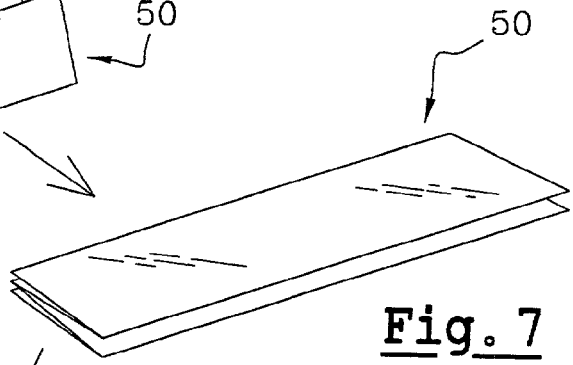

Longitudinal fold lines 54, 56 and 58, which delineate four strips or panels 60 of roughly equal width are depicted in dotted line in FIG. 5.

The sheet 50 is then folded according to FIG. 5. The direction in which the strips 60 are folded with respect to the longitudinal lines 54 and 58 is the opposite direction to the direction of the longitudinal line 56, so that a sheet 50 of the type folded into an M is formed, in accordance with FIGS. 6 and 7.

Figure 8:
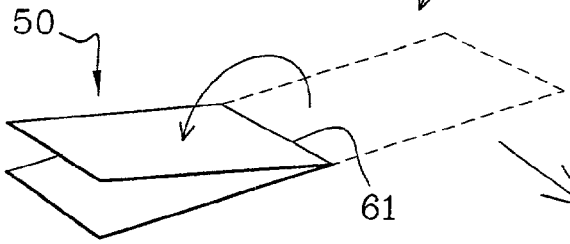

The sheet 50 is then folded about a first transverse fold line 61 according to FIG. 8.

Figure 9:
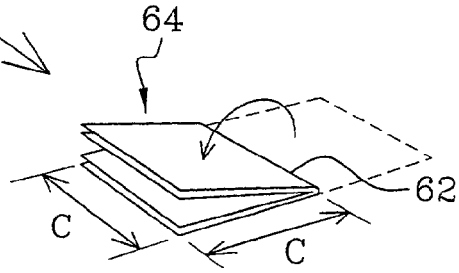

FIG. 9 depicts the sheet 50 during the final folding into sixteen equal parts about a second transverse fold line 62.

In the remainder of the description, the sheet 50 folded into sixteen is termed the folded tissue and is denoted by the reference 64.

The dimensions C of the sides of the folded square tissues 64 are between 50 and 58 mm.

Advantageously, to simplify the manufacture of the folded tissue 64, a reel of flexible material pays out a web which is folded along the longitudinal fold lines 54, 56 and 58 (this folding preferably being performed in the direction of unrolling of the web). This web is then cut to form square sheets 50 which are then folded along the first and then the second transverse fold lines 61 and 62 respectively.

According to an alternative form, the sheet 50 is folded about the longitudinal line 56 then is folded in just one direction about longitudinal lines 54 and 58 which are then superimposed. The transverse folding may then consist in a folding operation similar to the one described above or in a folding operation of the M-fold type.

The folded tissue 64 may also be the result of two foldings of the sheet 50 of the M-fold type, one of them longitudinal and the other transversal.

Other combinations of folds which are not detailed here also make it possible to obtain folded square tissues 64.

Such folding operations make it possible to obtain tissues 64 which are symmetric particularly with respect to their diagonal, which is not the case with tissues of known types produced by a combination of folding into four, as described above, and folding into three, for example of the Z-fold type.

The packet 20 according to the invention has smaller dimensions than the packet 20 according to the state of the art, without decreasing the size of the tissues 64.

The folded tissues 64 are easier to extract from the packet 20 because their symmetric square shape allows for a uniform and balanced distribution of the forces of friction between the folded tissue 64 extracted and the inside of the wrapper 21.

In accordance with FIG. 3, the moving flap 36 is articulated about an axis 70 which, in this instance, is coincident with the edge 71 common to the front frontal face 22 and to the upper face 30. Thus, the axis 70 is roughly parallel to the parallel planes containing the folded tissues 64. In the open position, according to FIG. 2, the flap 36 uncovers a region 86 for grasping.

Advantageously, for a pack as depicted in FIG. 3, the moving flap 38 of which is in the open position, the area of the region 86 for grasping is between one third and one half of the area of the front frontal face 22. This feature, combined with the parallelepipedal format of the packet 20 with square frontal faces 22 and 24 according to the invention, promotes the grasping of the tissue 64 and makes it easier to extract.

According to an alternative form which has not been depicted, the flap 36 is made in one of the side faces 26 to 32 of the packet 20. The axis 70 may then be approximately perpendicular to the parallel planes containing the folded tissues 64.

According to another alternative form of the invention, depicted in FIGS. 10 to 13, the moving flap 36 is a part of the wrapper 21 which is delimited by a precut 72 of the wrapper 21 and arranged in a corner 74 of the packet 20 of tissues.

The precut 72 may comprise two portions which are joined together and each of which extend on a separate face of the packet 20.

In what follows, the precut 72 comprises three portions, each of which extends over a separate face of the wrapper 21.

A first, central or intermediate, portion 76 is made in a first face, in this instance the front frontal face 22. It consists, for example, of an arc of a circle, the centre of which approximately corresponds to the vertex, that is to say the point of concurrency of the three edges delimiting the corner 74 of the packet 20, and which extends between two concurrent edges 71 and 78 which correspond to the two edges of the front face 24. The dimensions of the arc of the circle are preferably similar to those of the end of a user's thumb.

The second and third, end, portions 80 and 82 each extend along a second and third face, in this instance along the upper side face 30 and the right-hand side face 28 respectively.

Each end portion 80, 82 is a straight-line segment parallel to the edge 84 which corresponds to the intersection of the faces 28 and 30, and extends over a short length of a few mm.

Figure 11:
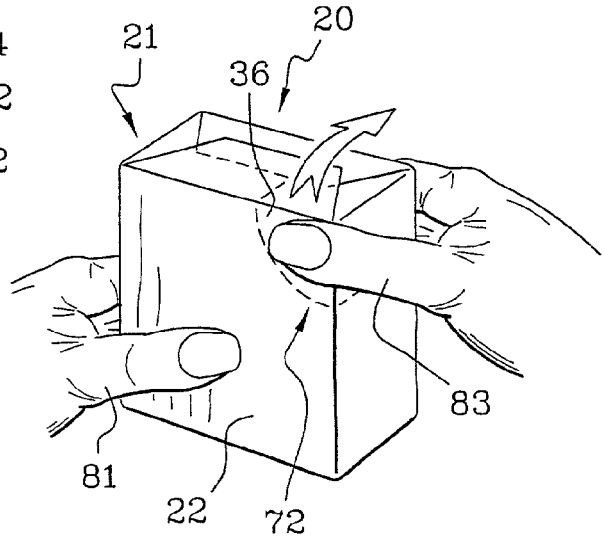
FIGS. 11 to 13 are diagrammatic perspective views illustrating the successive steps in uncovering the region for grasping of a packet of tissues similar to the one depicted in FIG. 10.

At the time of first use, according to FIG. 11, the user holds the packet 20, for example in his left hand 81, if he is right-handed, in a vertical position, with the frontal face 22 facing him. He then pushes on the flap 36 with a digit, which may be the thumb 83 of his right hand, so as to cut the portions of wrapper 21 located between the precut holes 72. The flap 36 is thus free to move.

Figure 12:
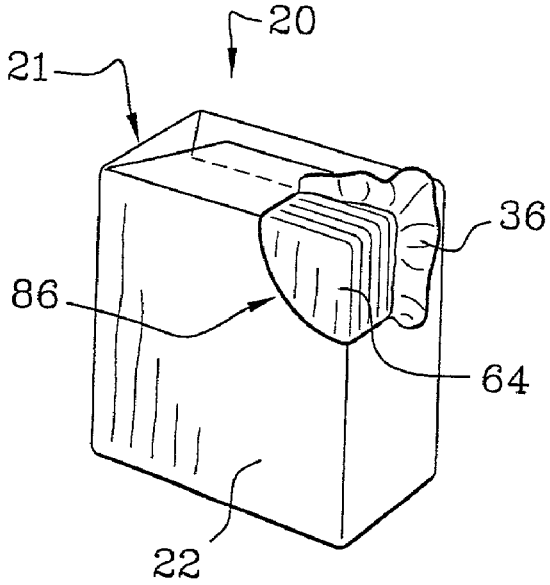

To remove a folded tissue 64 from the packet 20, the user has to continue the pressure he is exerting with his thumb so as to cause the mobile flap 36 to open, uncovering a region 86 for grasping, according to FIG. 12, which is located in the top corner. He can then easily grasp a corner of a tissue 64 and extract it from the wrapper 21.

Advantageously, the packet 20 may be opened with just one hand. For example, the packet 20 may be held between the thumb and middle finger and the index finger may uncover the region 86 for grasping.

The tissue 64 is extracted mainly along a diagonal of the front frontal face 22 of the packet 20 and is made easier because the friction forces are distributed across the two sides of the tissue 64 adjacent to the region 86 for grasping.

When the tissue 64 is removed from the wrapper 21, the region 86 for grasping is covered again by the moving flap 36.

Figure 13:
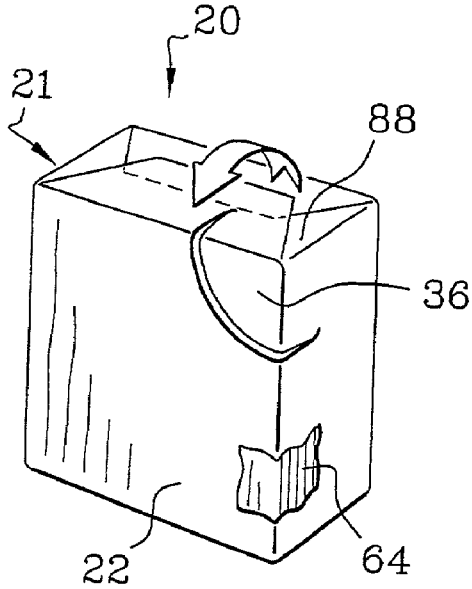

The moving flap 36 may also automatically return to the closed position according to FIG. 13.

The movement whereby the moving flap 36 returns to its closed position is brought about in particular by the elasticity of part of the wrapper 21 located in a region 88 lying between the two free ends of the second and third portions 80 and 82 respectively, which tends automatically to return the moving flap 36 to the closed position.

Such a packet 20 of folded tissues 64 makes it possible to dispense with the holding means 42, which reduces manufacturing costs.

In addition, the moving flap 36 allows the packet 20 to close again more hermetically than was the case in the state of the art. This is because the opening is narrower and the mobile flap 36 is held in the closed position by the elastic effect of the region 88. The folded tissues 64 are therefore better protected and do not get as dirty.

As the front frontal face 22 and rear frontal face 24 are square, the packet 20 is easier to manufacture because the precut 72 can be made in any one of the eight corners of one of the frontal faces 22 and 24.

The wrapping process is also simplified because it is not necessary to orientate the size of the folded tissues 64 with respect to the width L3 or height H3 of the packet 20.

For the same reasons, the packet 20 of tissues 64 is simpler to use. This is because whatever corner the mobile flap 36 is made in, rotating the packet 20 about one or more axes perpendicular to its faces allows the moving flap 36 to be brought into the most convenient position for the user. That is to say, for example, into the top right-hand corner for a right-handed person. There is no idea of height or width. Extracting a folded tissue 64 is therefore an act that the user will find easy and natural.

In addition, it is possible to open the packet 20 with just one hand, making it easier to use.

The first portion 76 may have a different shape, such as a straight-line segment shape, which may be perpendicular to a plane passing through the edge common to the second and third faces and through the bisector of the angle formed by the other two edges.

The invention claimed is:

1. A packet of stacked absorbent paper tissues, comprising:

a plurality of absorbent paper tissues forming a tissue stack;

a wrapper formed of a flexible wrapping sheet configured to wrap the tissue stack; and an opening part within the wrapper to, when open, provide an uncovered region for grasping at least one tissue from the tissue stack, the wrapper and tissue stack having a parallelepiped overall shape defined by a height, width, and a thickness, the height and width being equal so that the packet has a square front face and a square rear face, each tissue of the tissue stack being folded in a square of sixteen equal areas within the tissue, each tissue having three fold lines defining four panels of approximately equal width, and two further fold lines orthogonal to the three fold lines, the three fold lines and the two further fold lines defining sixteen equal areas within the tissue, directions of folding of the panels with respect to outer fold lines of the three fold lines being mutually opposing to the direction of folding the panels with respect to an inner fold line, so that the interior surface of the two outer panels is folded in an outwardly manner with respect to the two inner panels, and directions of folding of the panels with respect to the two further fold lines being in succession about a first of the two fold lines and a second of the two fold lines.

2. The packet of claim 1, wherein the height and width of the wrapper and tissue stack are between 50 and 58 millimeters.

3. The packet of claim 1, wherein the opening part comprises a flap which can move between an open position uncovering the region for grasping and a closed position covering the region for grasping.

4. The packet of claim 3, wherein a surface of the region for grasping uncovered by the flap is between one third and one half of an area of a wrapper face comprising the opening part.

5. The packet of claim 4, wherein the flap is articulated about an axis approximately parallel to an edge of the packet.

6. The packet of claim 5 wherein the flap comprises a closure element configured to hold the flap in a closed position.

7. The packet of claim 6, wherein the closure element comprises an adhesive strip that can be repeatedly unstuck and stuck onto a fixed part of the wrapper.

8. The packet of claim 3, wherein, the flap is a part of the wrapping sheet delimited by a cut in the wrapping sheet comprising two portions of the wrapping sheet joined together, the two portions extending over separate faces of the packet.

9. The packet of claim 3, wherein, the flap is part of the wrapping sheet delimited by a cut in the wrapping sheet arranged in a corner of the packet and comprising three portions of the wrapping sheet, each of the three portions extending over a separate face of the packet, a first portion extending over a first face between two concurrent edges of the packet, and a second portion and a third portion extending over a respective second face and a third face of the packet from ends of the first portion.

10. The packet of claim 9, wherein, the first portion is an arc of a circle, the center of the circle corresponding approximately to a point of concurrency of three edges delimited the corner of the packet.

11. The packet of claim 9, wherein the first portion comprises at least one straight-line segment.

12. The packet of claim 9, wherein the first face is the front face.

13. The packet of claim 9, wherein the first face is adjacent to the front face.

14. The packet of claim 9, wherein the first face is adjacent to the rear face.

15. A packet of stacked absorbent paper tissues, comprising:

a plurality of absorbent paper tissues forming a tissue stack;

a flexible wrapper configured to wrap all faces of the tissue stack; and an opening part within the wrapper to, when open, provide an uncovered region for grasping at least one tissue from the tissue stack, the wrapper and tissue stack having a parallelepiped overall shape defined by a square front face and a square rear face, each tissue of the tissue stack being folded in a square of sixteen square areas, each tissue having three fold lines defining four panels of approximately equal width, and two further fold lines orthogonal to the three fold lines, the three fold lines and the two further fold lines defining the sixteen equal areas, the panels being folded with respect to the three fold lines so as to form an M shape when viewed from an end of the tissue.

16. An absorbent tissue packet, comprising:

a tissue stack; and a wrapper covering all faces of the tissue stack, the wrapper and tissue stack having a square front face and a square rear face, each tissue of the tissue stack having three fold lines defining four panels of approximately equal width, and two further fold lines orthogonal to the three fold lines, the three fold lines and the two further fold lines defining sixteen equal areas, the panels being folded with respect to the three fold lines to form an M shaped end view.

* * * * *

UNITED STATES PATENT AND TRADEMARK OFFICE

CERTIFICATE OF CORRECTION

PATENT NO. : 7,100,769 B2
APPLICATION NO. : 09/852712
DATED : September 5, 2006
INVENTOR(S) : Christian Tourre et al.

It is certified that error appears in the above-identified patent and that said Letters Patent is hereby corrected as shown below:

Claim 10, Column 8, line 41, “delimited” should read --delimiting--.

Signed and Sealed this

Twenty-first Day of November, 2006

JON W. DUDAS
*Director of the United States Patent and Trademark Office*